United States Patent [19]

Wood

[11] Patent Number: 4,682,777

[45] Date of Patent: Jul. 28, 1987

[54] BOARD GAME

[76] Inventor: Thomas J. Wood, 2249 W. Villa Maria, Phoenix, Ariz. 85023

[21] Appl. No.: 883,925

[22] Filed: Jul. 10, 1986

[51] Int. Cl.[4] ..... A63F 3/00

[52] U.S. Cl. ..... 273/243; 273/256

[58] Field of Search ..... 273/243, 249, 256, 272, 273/299

[56] References Cited

U.S. PATENT DOCUMENTS

| | | | |
|---|---|---|---|
| 3,642,286 | 2/1972 | Moore | 273/243 |
| 3,939,578 | 2/1976 | Coffey | 273/243 |
| 3,984,106 | 10/1976 | White | 273/243 |
| 4,032,153 | 6/1977 | Daum | 273/256 |
| 4,140,319 | 2/1979 | Aycock et al. | 273/256 |
| 4,557,485 | 12/1985 | Lardon | 273/249 |

FOREIGN PATENT DOCUMENTS

| | | | |
|---|---|---|---|
| 908821 | 10/1945 | France | 273/243 |

OTHER PUBLICATIONS

"What's The Word" Game Rules, Karian Corporation, 1984.

*Primary Examiner*—Richard C. Pinkham
*Assistant Examiner*—Benjamin Layno
*Attorney, Agent, or Firm*—Charles P. Padgett, Jr.

[57] ABSTRACT

The present invention relates to a definition-word spelling game which is both educational and entertaining. The game uses a game board, a deck of cards, player pieces, letter-covering pieces, marker pieces and a chance device. The four sides of the game board are each defined by one of four different and distinct characteristic colors. The four player pieces, four sets of cards, four sets of cover tiles and four sets of markers are all similarly color coded. The board has four special function corners and each side between adjacent corners includes seven spaces for a total of 28. Each space includes a different and distinct letter of the alphabet with the remaining spaces being assigned special functions. A player landing on a given space, draws a card corresponding to the color on that section of the board the player is then read a definition of a word which normally starts with the letter on his given space. If the player correctly guesses the word, he covers that letter with one of the tiles of his color and he must then spell the word. If he spells it correctly, he wins a marker of his color. Once a player collects three markers he can exchange the markers for a letter covering tile. His turn continues until he fails to guess or spell a word correctly. The player who covers the most letters, wins the game.

20 Claims, 8 Drawing Figures

BOARD GAME

BACKGROUND OF THE INVENTION

1. Field of the Invention

This invention relates generally to board games, and more particularly to a board game having various types of pieces for various purposes and which can be used for both educational and entertainment purposes and which involves guessing the correct word for a given definition and then the correct spelling of that word.

2. Description of the Prior Art

The prior art contains many different types of board games and many different types of word games. However, the prior art teaches few if any games which are both educational and entertaining and which involve words, their definitions, and their spelling, and wherein the game is played on a board having different colors corresponding to different playing spaces, different player pieces, different markers, different cover tiles, and different sets of card categories.

Many of the educational type of word games of the prior art quickly become too easy or boring and others are far too difficult for a given age group or a given intelligence group. However, the board game of the present invention can have the word categories chosen to meet the needs of any given group from early elementary school age through those groups with the advanced educations; and various decks can be used and substituted, if desired, even when adults and children are playing together, simply by ordering a deck of cards for the child's age group along with a deck of cards for the appropriate class of adults involved.

Not only are most of the prior art word games boring, but they seldom use player pieces which are moved about the board so that cards are selected; words guessed by their definitions and then spelled; and rewards given-including covering tiles or blocks for covering a letter when the correct word is guessed for the definition given, and markers which are earned when the word is correctly spelled. These markers can be used or "traded-in" for additional cover tile of block, for covering a selected uncovered letter, as desired.

Few if any of the word games of the prior art combine an element of luck along with strategy and one's ability to recognize words from their definition and to correctly spell those words in order to cover the most letters with the cover tiles in order to win the game.

The present invention solves substantially all of the problems of prior art word games by providing an intellectually stimulating board game which is both educational and entertaining, and which can be played competitively or simply for fun while teaching or testing ones ability to recognize a word from a given definition and one's ability to then correctly spell that word.

BRIEF SUMMARY OF THE INVENTION

It is an object of the present invention to provide a word game which is both educational and entertaining.

It is another object of the present invention to provide a board game for testing ones knowledge of words from their definitions and for testing ones ability to spell defined words all in the context of a board game.

It is still another object of the present invention to provide an intellectually challenging and stimulating board game wherein player pieces are advanced along player spaces at the sides of the board by chance means, and a card is chosen by the color of the particular side and a definition is chosen by the letter within the particular player space on which the player piece lands for quizzing the player with the selected word definition.

It is another object of the present invention to generally read the definition of the word on the selected card which starts with the letter in the player space on which the player has landed, and requiring that he successfully guess the word whose definition is given in order to earn a cover tile for covering the letter, thus moving one step closer to winning the game, since the player covering the most letters wins, and for then enabling the player to correctly spell the defined word in order to earn a marker which can be turned in or exchanged in sets to earn additional covering tiles.

It is yet another object of the present invention to provide a game board with substantially all of the letters of the alphabet thereon, wherein the four sides of the board correspond to the four colors of four sub-decks of cards, and a different and distinct indicia means contained on each of the player spaces along the sides of the board correspond to different letters of the alphabet and to the first letter of different words whose definitions will be given or to special symbol indicia which can be used to force an opponent to remove a previously placed cover tile or the like.

It is a further object of the present invention to provide a chance means for moving players about the four sides of a game board and challenging the player to provide words whose definitions are given by cards corresponding to the space on which the player lands in his turn and then to correctly spell the defined word prior to going again and attempting to cover the most letters on the board thereby winning the game.

It is a yet a further object of this invention to provide a board game which is sufficiently mechanical in nature to appeal to all types of game players while still having as its primary goal the guessing of words whose definitions are given and the spelling of those words.

The present invention teaches a game board which includes four corner player spaces and four sides. Each of the sides includes a set of predetermined number of player spaces each, for example, seven player spaces each, with each of the four sets having a different and distinct characteristic color. A deck of playing card means includes four sets of cards with each set having a different and distinct characteristic color corresponding to the colors of the corresponding sets of players spaces on the sides of the game board. Each card further includes a plurality of definitions of words on one side of the card and the correct spelling of the defined words on the opposite side of the card. Whenever a player lands on a particular color game space, the color of the space determines which of the four decks the card is chosen from and the letter or indicia means contained or carried by the space on which the player has landed determines, generally, the first letter of the word to be defined on the selected card.

Since each of the four sides of the boards includes a set of seven player spaces between opposite corner spaces, there are a total of 28 spaces, which may, for example, correspond to indicia indicative of the 26 letters of the alphabet plus first and second special symbols, as hereinafter described. The corner spaces may contain indicia means indicative of "Lose a Turn"; "Choose Any Letter"; "Roll again"; and "Free Marker Peg"; indicating that the player may lose his turn if he lands on that given corner space, select any letter from the four decks for guessing the word defined as starting with that letter; for enabling the player to roll again; and for obtaining a free marker peg. Whenever a given number, for example three, marker pegs are collected, they may be turned-in or exchanged for a cover block or tile which may then be used to cover any selected uncovered letter on the board. Again, since the object of the game is to cover the most letters in order to win so that the more markers which can be earned to cover the letter of the initial playing space by guessing the word matching the given definition and the greater number of marker pegs which can be earned by correctly spelling the word for later exchange for a cover block will ultimately determine the winner.

The present board game includes four player pieces each having a different and distinct characteristic color corresponding to the colors of the four sets of player spaces on the four sides of the game board. The game also includes four sets of markers, for example, of three marker pegs per set, where each set has a different and distinct characteristic color corresponding to the colors of the four player pieces. The marker pegs or markers being earned by a player after he correctly guesses the word for his selected definition determined by the selected card depending upon the player space on which he lands at the beginning of each turn, and then correctly spelling the defined word to earn a marker. There are also four sets of fourteen or so cover blocks or tiles, where each set has a different and distinct characteristic color corresponding again to the colors of the four player pieces, and a plurality of the cover tiles are used to cover up the letters when the proper word is guessed from the definition and in other special cases as hereinafter described.

The player covering the most letters being declared the winner of the game. The game may include additional sets of card decks for given educational, intellectual and age levels so as to avoid frustration and for enabling children to play with their elders and the like. Furthermore, the game includes a chance means for selectively moving the player pieces around the sides of the board, and in the preferred embodiment, the chance means includes a single die having the conventional indicia or dots corresponding the numbers 1–6 on the six surfaces thereof. Alternatively, any type of chance means such as a spinner, a pair of dice, specialty die or dice, a special deck of cards or the like could also be used. The cover tiles or blocks are sized or dimensioned to enable them to cover a given letter indicated by the indicia means carried by a given player space, and the markers may be of any size or shape but are preferably chosen so as to have the ability to stand and be readily observable by all players on special spaces on the interior side of the board adjacent the playing spaces so that each player can see how many markers the other players have accumulated at any given time, since the colors of the markers match the colors of the adjacent player spaces, and of course, the corresponding characteristic color of the player piece corresponding to that player.

The board game of the present invention may also include means carried by the interior of the board, such as marked off spaces or rectangles for carrying each of the four decks or sub-decks of the cards, for storing each of the four sets of cover tiles, for storing each of the four sets of markers, and the like. Alternatively, a lazy susan-type tray can be used which includes four central square cubicles having top openings which are adapted to receive a given player piece and markers of a given characteristic color in each of the four compartments thereof, while four card trays are disposed centrally about the relatively square lazy susan tray for containing each of the four colored decks of cards. The four corners can be used for stacking the four sets of cover tiles for storage purposes. The die could also be contained within one of the central compartments and the lazy susan could rotate about a central spindle or axis whose opposite end may be placed through an aperture in the center of the game board or the like for enabling the tray to be turned as card pieces are selected by the player whose turn it is.

In playing the game, all players start at the "Free Roll" space, and the players roll the die or chance means to see who goes first. The player with the highest number goes first. When a players piece lands on a letter, he will then receive a card corresponding to the color of that side and word definition corresponding to a word starting with that letter. He will then be read the definition from the selected card and will have to guess at the word whose definition he has received. If he correctly guesses the word whose definition he is given, he gets to select one of his correspondingly colored cover tiles or blocks which he then places over the letter on the space which he currently occupies, thus claiming that space for himself. He then tries to correctly spell the word. If he spells the word correctly, he gets one free marker peg which he places on the appropriate space in front of him. Once he has accumulated three marker pegs, he can exchange them or turn them in for a marker tile which he can use during that turn to cover any uncovered letter on the board with one of his tiles and thus claim an additional space. If he misses the word definition, his turn is over. If he correctly guesses the word and correctly spells the word, his turn continues with the chance means being used to determine the next player space on which he lands. If the player gets the definition and misses the spelling he still gets to cover the letter with his tile but he doesn't receive a marker peg and he loses his turn at that point. If a player lands on a covered letter, he will not be able to cover that letter, but if he guesses the word an spells it correctly, he earns a marker peg and then continue with his turn.

It is an object of the game of the present invention to cover more letters than the opponents. When two players are involved, the first to cover fourteen letters wins, whereas if three or four players are involved, the player with the most letters covered at the end of the game wins. Any player landing on the "Free Marker Peg" space will receive one free marker peg of his particular color and any player landing on the any letter space may choose any uncovered letter on the board, move his playing piece to the corresponding playing space, and then guess the word from the definition. If he guesses the word from its definition, he then gets to cover the letter. If he also spells the word correctly, he gets a marker peg, as previously described, and then rolls again to continue his turn. Any player landing on the corner space marked "Lose Turn" immediately loses his turn. Any player landing on the space which says "Roll Again" will get to roll the chance means again during that turn.

Each of the four sub-decks or four boxes of cards making up the master deck include two sets of cards with seven letters and two sets with six letters, respectively for a total of 26 letters or all the letters in the alphabet. Each card in the first and third box will contain seven definitions on one side and seven correctly spelled words on the other while each card in the second and fourth box contain six definitions on one side and six correctly spelled words corresponding to those definitions on the opposite side. Each box will contain approximately 100–300 cards, although any given number may be used, as desired.

Any time a player lands on such letters as J,K,Q,U,V,X,Y,Z, the player may be given a definition that begins with those letters or he may be given another definition of a word which does not begin with those letters, since the number of words starting with those letters in these categories is limited. He will be told what letter the word actually starts with, and if he gets the word and the spelling correct, he covers the letter with his tile and continues his turn as previously described. Words that need to be capitalized must be spelled with the capital letter or the spelling is wrong!

The present invention also includes a pair of special symbols located on two of the sides of the board. When a player lands on the first special symbol space, he may choose any letter that his opponent has covered with the opponents cover tile and if he guesses the word correctly from the given definition the opponent must uncover that letter so that it is open for anyone to cover. The person correctly guessing the word from the given definition then continues his turn by rolling again and moving to the next space. If, the opponent or opponents have no covered letters, the person landing on the first special symbol simply proceeds to roll again. When a player lands on the second special symbol, he may choose any letter that his opponent has covered and if he guesses the word correctly from the given definition, he is then given a chance to spell the word correctly. If he also spells the word correctly, his opponent must uncover that letter for anyone to take and the player whose turn it was rolls again to continue his turn.

These and other objects and advantages of the present invention will become more fully understood from reading the detailed description of the preferred embodiment, the claims, and the drawings which are briefly described hereinbelow.

DETAILED DESCRIPTION OF THE PREFERRED EMBODIMENT

Figure 1:
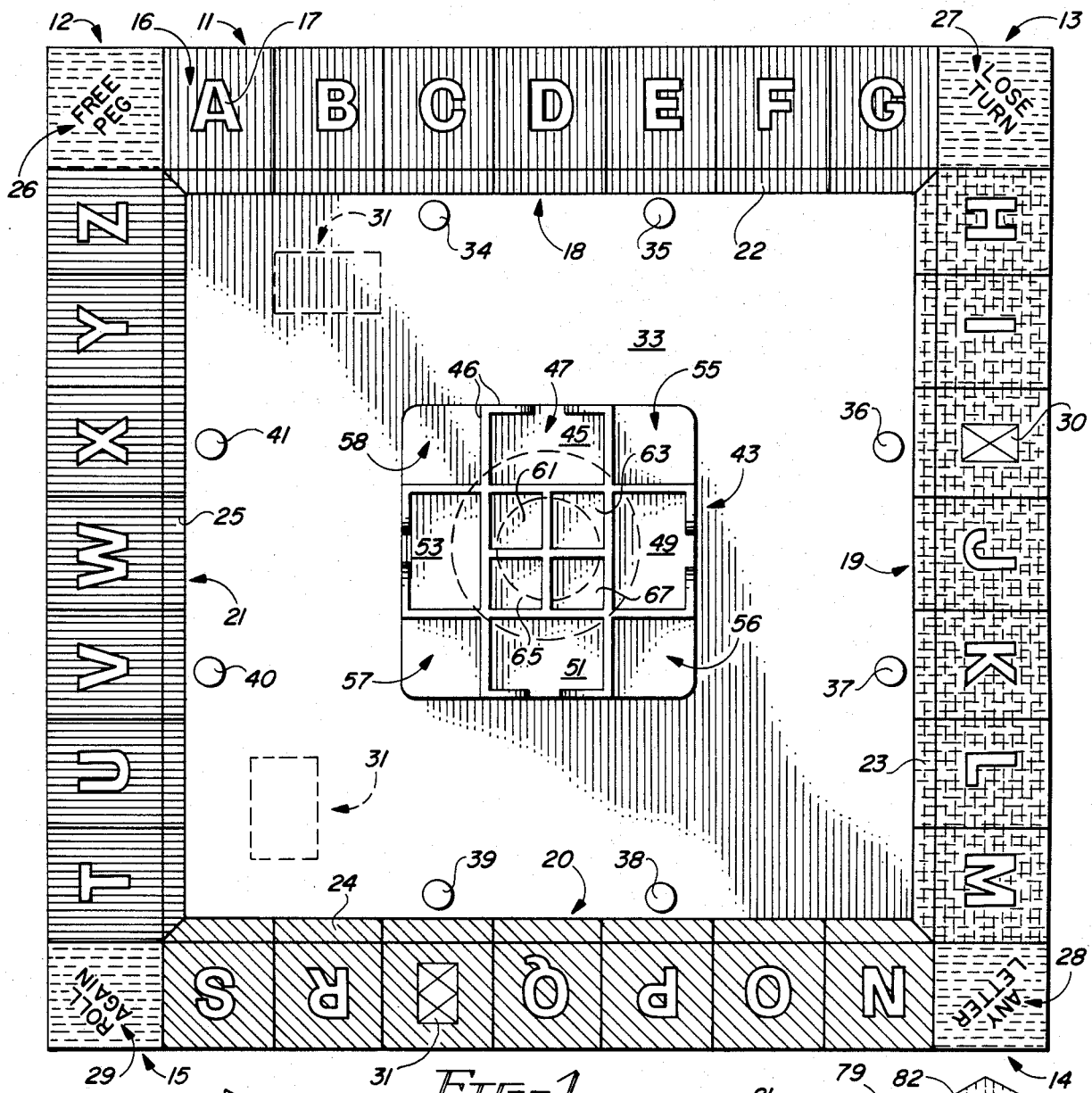
FIG. 1 is a top plan view of the game board apparatus of the present invention.

The game of the present invention is illustrated in FIG. 1 as including a generally square game board 11 which has four generally square corner spaces 12, 13, 14, and 15. Four sets of seven player spaces 16 are operatively disposed between opposite corner pieces so that seven of the player spaces 16 are operatively disposed between each adjacent opposite pair of corner spaces 12, 13, 14, and 15. The first set 18 of the seven individual player spaces 16 are disposed between the opposite and adjacent corner space 12 and the corner space 13 and each of the seven player spaces include a first different and distinct characteristic color 22. The first player space 16 adjacent the "Free Marker peg" space or corner space 12 contains, carries or bears an indicia means 17 indicative of the first letter "A" of the alphabet. The second sequential player space 16 contains the letter "B"; the third player 16 space contains the letter "C"; the fourth player 16 space contains the letter "D"; the fifth player space 16 contains the letter "E"; the sixth player space 16 contains the letter "F"; and the seventh and last player space 16 adjacent the second "Lose a Turn" space or corner space 13 contains the letter "G". Each of the seven player spaces 16 between the opposite corner spaces 12 and 13, therefore, include a first different and distinct characteristic color 22, and each of the first set of seven player spaces 16 includes pair is different and distinct letter of the alphabet, as indicated by the seven letters A–G, disposed on the first side 18 of the game board 11, respectively.

Similarly, the seven blocks or player spaces 16 disposed between the second corner 13 and the "Choose Any Letter" or third corner space 14 contain indicia means indicative of the six letters of the alphabet H–M with the seventh player space being disposed at any given location along the second side 19 containing a first special purpose symbol 30 whose function will be described hereinafter.

The third set 20 of seven player spaces 16 which are operably disposed between the third corner 14 and the "Roll Again" or fourth corner 15 include a third set 20 of seven player spaces 16 each including an indicia means for defining the letters of the alphabet N–S, with one of the player spaces including an indicia means indicative of a second special purpose symbol 31, as hereinafter described. Lastly, the fourth set 21 of seven player spaces 16 disposed between the corner 15 and opposite corner 12 is defined by a fourth different and distinct characteristic color 25 and contain indicia means indicative of the seven letters of the alphabet T–Z, respectively.

The first corner space 12 includes indicia means 26 indicating that the player landing on that corner space receives a "Free Marker Peg" while the indicia means 27 on corner space 13 indicates that a player landing thereon will "Lose A Turn". The indicia means 28 on the third corner space 13 indicates that the player landing thereon may "Select Any Letter" from which he may attempt to guess the word whose definition is selected; while any player landing on the fourth and last or "Start" corner containing indicia indicating "Roll Again" will extend his turn by rolling the chance means or die for another turn. The four sets 18, 19, 20, and 21 of seven each player spaces 16 represent four different and distinct characteristic colors making up the four sides 18,19,20,21, of the game board 11 and the four sides define a central interior space 33 which has its own characteristic color different and distinct from the colors of the four sides 18,19,20, and 21 of the game board 11. A first pair of space indication or indicator means 34 and 35 may be provided on the interior 33 of the game board 11 adjacent the first set 18 of player spaces 16, and these spaces 34 and 35 are sized so that the individual marker pieces, as hereinafter described, can be placed or disposed hereon once earned by a player whose color matches the color 22 of that particular set 18 of seven player squares or spaces 16. Similarly, the second pair of marker spaces 36 and 37 are disposed adjacent the set 10 of player blocks or spaces 16 on the interior 33 of the board 11, while the third pair of defined spaces 38 and 39 are disposed adjacent the third set 20 of seven player spaces 16 on the interior 33 of the game board 11. Lastly, the fourth pair of marker spaces 40 and 41 are disposed inwardly of the fourth and last set 21 of player spaces 16 on the interior 33 of the game board 11, as previously described. The defined area, space, configuration or shape of the marker-receiving space being indicated by the marker spaces 34–41, respectively, are designed to enable the individual markers or marker pegs, as hereinafter described, to be operatively disposed on or within those defined spaces for easy observation of all players in the game.

FIG. 1 further shows that a plurality of defined or marked spaces 31 may be spaced about the interior 33 of the game board 11 to position the various apparatus of the game including the four decks of cards, four sets of markers, and four sets of cover tiles. Alternatively, in the preferred embodiment of the present invention, a generally square holding tray 43 is used for holding the various apparatus of the game both during play and for storage purposes. The tray 43 includes four generally square central compartments 61, 63, 65 and 67 which are adapted to hold the four different and distinct player pieces and the four sets of correspondingly colored marker pegs, respectively. Four generally rectangular card trays 45, 49, 51 and 53 each having side portions 46 and a card grasping or sliding aperture or slot 47 are used to house or contain the four different and distinct characteristic colored sub-decks or sets of cards corresponding to the colors of the four player pieces, respectively. Lastly, the four corners 55, 56, 57, and 58 of the tray 43 may be used to stack or store the player cover tiles or blocks used to cover the letters with the different player's color tiles being stacked in different corners, respectively.

Figure 2:
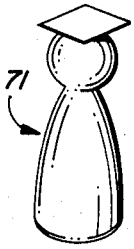
FIG. 2 is a perspective view of one of a set of four player pieces useable in the game of FIG. 1.

FIG. 2 shows one of a set of four different and distinct player pieces each having a characteristic color corresponding to the different and distinct characteristic colors 22,23,24, and 25 of the four sides of the game board 18,19,20, and 21, respectively. The four player pieces 71 are initially placed on the corner space 15 bearing the indicia 29 meaning "Roll Again" and play proceeds clockwise around the board with each of the player spaces 16 and the corner spaces 12,13,14,15 being counted as one space for a total of 32 spaces required to make a complete circuit, cycle or circle around the game board 11.

Figure 3:
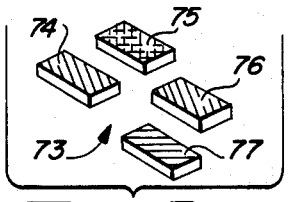
FIG. 3 is a perspective view of a set of cover tiles or blocks having colors corresponding to the four player pieces of the game of the present invention.
Figure 4:
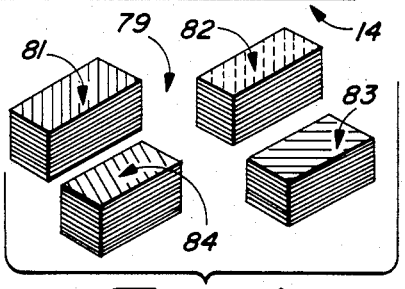
FIG. 4 is a perspective view representing four different colored decks of cards corresponding to the four colors of the four player pieces and of the four sides of the board with each including word definitions and words corresponding thereto.

FIG. 3 represents a set 73 of cover blocks or cover tiles having four different and distinct characteristics colors represented by the reference numbers 74, 75, 76, and 77 corresponding to the four colors of the four player pieces 71 and hence the four colors 22,23,24, and 25 of the four sides 18,19,20,21 of the game board 11. The game also includes a master deck 79 of playing cards which is preferably divided into four sub-decks or boxes of cards 79 including sub-decks or sets 81, 82, 83, and 84, each of which has a different and distinct characteristic color corresponding to the four colors of the player pieces 71 respectively, as previously described.

Figure 5:
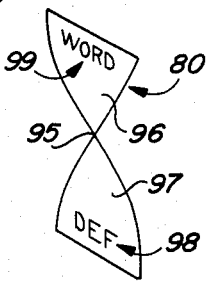
FIG. 5 is a perspective view of a twisted individual card from one of the sets of FIG. 4 showing at least one word definition on one side and the corresponding correctly spelled word on the opposite side.
Figure 6:
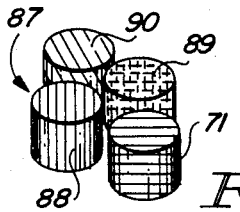
FIG. 6 illustrates an example of the marker pegs of the present invention.

FIG. 5 shows a twisted card 80 as having a plurality of definitions 98 (represented by the single word "Definitions") on one side 97 of the card 80 and the card is twisted as at 95 so that the opposite side 96 of the card 80 shows a plurality of words 99 (represented by the single word "Words") printed thereon. FIG. 6 shows a set 87 of marker pieces or marker pegs 88, 89, 90 and 91, each having different and distinct characteristic colors, again corresponding to the different and distinct characteristic colors of the decks of cards 79, the cover blocks or tiles 73, and player pieces 76, and the colors 22, 23, 24, and 25 of the four sides 18,19,20, and 21 of the game board 11 of the present invention.

Figure 7:
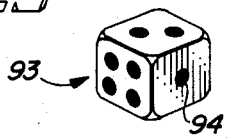
FIG. 7 represents a conventional die as the preferred embodiment of the chance means of the game of the present invention.

FIG. 7 shows the preferred embodiment of the chance means as being a conventional six-sided cubical die 93 having a plurality of spots, dots, or indicia 94 on the faces thereof. As commonly known, the six faces of the die 93 contain the numbers or dots corresponding to the numbers 1–6 so that a player rolling the die can move from one to six places depending on which side of the die faces up at the end of the roll.

Figure 8:
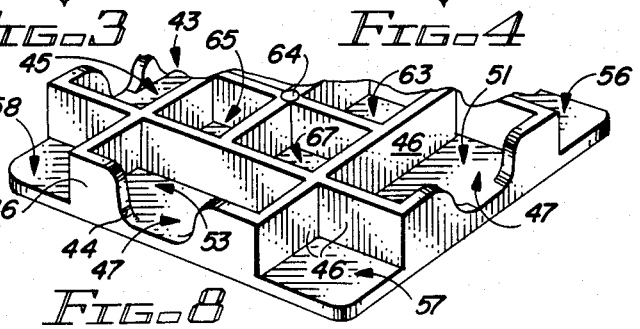
FIG. 8 is a perspective view, partially broken away, of the holding tray of the board game of FIG. 1.

Lastly, FIG. 8 discloses a holding tray apparatus 43 of the preferred embodiment of the board game 11 of the present invention which has a central section defined by the ribs or walls 46 crossing in the center 64 to divide the central section into four compartments 61, 63, 65 and 67, and including a rotatable spindle or axis 64 which may be anchored or which may have its opposite end inserted through a corresponding aperture or into an anchor in the center of the game board 11 so that the tray 43 is free to rotate in either a clockwise or a counterclockwise direction about the central vertical axis 64 so that a player can select the proper card from the proper colored card deck, the appropriate or properly colored marker peg, the properly colored cover tile, etc. from the tray simply by rotating it until the desired piece or card is most available or within easy reach of that player. The tray can also be used for storage purposes for all game pieces except the game board 11, desired.

In the preferred embodiment of the present invention, the game described above includes a game board 11, one die 93, twelve pegs or markers 87 divided into four sets of two or three pegs each with each of the four sets having its own different and distinct color corresponding to the different and distinct characteristic color of each of the four player pieces. The game further includes, in addition to the four player pieces, four sets of fourteen cover blocks or tiles for covering the letters on the player squares 16 once the word has been guessed from the definition given, and four sets or sub-decks of cards representing four general letter categories with a plurality such as seven or six definitions of words disposed on one side of the card and a corresponding plurality of seven or six words correctly spelled words corresponding to those definitions being disposed on the opposite side of the card, respectively.

The rules of the game of this invention are that all players start at one of the corner spaces such as the corner square space indicating or labeled. The players roll the die 93 and the player rolling the highest number goes first. When a player lands on a player space 16 of a given color, he will select or have selected for him, a card corresponding to that color which will then have six or seven definitions on one side of the card corresponding to the six or seven letters of the player spaces 16 on the particular side of the board on which the player has landed. The opposite side of the selected or chosen card will include six or seven properly spelled words corresponding to those definitions. The player selecting the card for the player who has just moved into the player space bearing a particular letter of the alphabet then reads the definition on one side of the selected card corresponding to the word starting with the letter disposed on the player space on which the player has landed, and the player whose turn it is, must then guess the word corresponding to the given definition.

If he guesses the word correctly, he gets to select one of his own colored cover tiles and covers the letter disposed on the player space on which he now stands, with the tile covering the appropriate letter of the alphabet to signify that he has captured that letter. He then attempts to correctly spell the previously defined word. If he fails to spell the word correctly his turn ends. If he fails to guess the defined word in the first place or if he misspells the word, his turn ends. If, however, he correctly guesses the defined word and then correctly spells the word, he receives one free marker peg of his own color which he places in one of the spaces disposed in front of the game board colored side corresponding to his color and when he has accumulated a given number such as three marker pegs, he can turn them in or exchange them for a cover tile or block and cover any previously uncovered letter on the playing surface which he chooses with one of his correspondingly colored cover tiles.

If the player gets or guesses both the word and its spelling correctly, he can continue his turn by rolling the die again and moving the indicated number of player spaces. If he gets the definition, but misses the spelling, he still gets to cover the letter with his tile, but he does not receive a marker peg and he loses his turn. If he lands on a covered letter, he cannot cover that letter, but he must still guess the word corresponding to the definition of the appropriately colored card and indicated letter, if he correctly guesses and spells the word, he earns a marker peg and continues his turn.

The object of the game is to cover more letters than any of the opponents so that when two players are playing, the first player to cover fourteen letters wins the game. Alternatively, when three or four players are playing, the player with the most covered letters at the end of the game (or when all the letters are covered) wins the game.

Additional attractions or variations in the play of the game are added by the corner space 12, since when a player lands in this space, he receives a free marker peg which he places in the appropriate defined marker-receiving space in front of his colored side of the board or, if he has already or previously accumulated two marker pegs, he can turn the three markers in for a tile and cover any uncovered letter on the board which he selects or chooses. Alternatively, when a player lands on the corner square 14 he may "Select Any Letter" (uncovered) anywhere on the board and the appropriate card and definition is then chosen or selected for the appropriate letter such that if he both correctly identifies the word from the given definition and then correctly spells that word, he will be able to cover that letter wherever it is on the board with his cover tile and he then receives a marker peg before resuming his turn with another roll. Of course any player which lands on the "Lose a Turn" space of corner 13 loses his turn; while any player landing on the "Roll Again" space of corner 15 is allowed to roll again for another turn.

It will be recognized that the card categories are divided into four sets or sub-decks by colors and may include six or seven definitions corresponding to the six or seven letters in that particular colored side of the board. However, since some of the letters are relatively infrequent in their usage in the English language, such as Q, U, V, X, Y, Z, the player landing on those letters may be given a card definition that does not begin with any of those letters. He will be told what, in advance, the letter his word starts with, and if he guesses the word and correctly spells it, he can cover that letter, receive a marker peg and continue his turn as previously described. Additionally, the first special indicia, special purpose symbol, or mark 30 which is disposed on one of the player spaces between the corners 13 and 14 signifies the following. When a player lands on this first special symbol 30, he may choose any letter that his opponent has presently covered, and if he guesses the word correctly from the definition given on the appropriately selected card, the opponent must uncover the tile so that it is open for anyone to subsequently cover should they land on it or the like. If the player whose turn it is then correctly guesses the correct spelling of the word, he receives a marker peg and continues his turn. If the particular opponents have no covered letters, the player simply rolls again.

If, on the other hand, the player lands on the second special function symbol 31, he may choose any letter that his opponent has previously covered, and if he guesses the word correctly from the given definition and then correctly spells that word, his opponent must uncover the letter so that it is open for anyone to take; and the player then receives a marker peg and is allowed to continue his turn.

It will be recognized by those of ordinary skill in the art that various modifications, variations, substitutions and changes can be made in the structure of the pieces, the colors used, the nature of the choice means, the layout of the board, and the like without departing from the spirit and scope of the present invention which is limited only by the appended claims.

I claim:

1. A word game comprising:

a generally square game board having four corner spaces and four sides, each of said sides including a set of "n" player spaces each, each of said sets of "n" player spaces having a different and distinct characteristic color and each of said "n" player spaces including indicia means with some of said player spaces bearing at least one single letter of the alphabet and the remaining player spaces bearing at least one special symbol;

a deck of player card means including four sets of cards, each of said sets of card having a different and distinct characteristic color corresponding to the different and distinct characteristic colors of said four sets of "n" player spaces of the four sides of said game board, and each of said cards within each of said four sets including a plurality of definitions on one side of the card and a plurality of correctly spelled words corresponding to those definitions on the opposite side of the card; the color of the card being selected according to the color of the particular side of the board on which a player lands on a given turn and the particular definition chosen from the selected card being given by the first letter of the defined word corresponding to the letter on the player space on which the player lands during that turn;

four player pieces each having a different and distinct color corresponding to the colors of said four sets of "n" player spaces;

four sets of marker means, each set of marker means having a different and distinct characteristic color corresponding to the different and distinct characteristic colors of said four player pieces, said marker means being earned by a player when he correctly spells the defined word after he has correctly identified the word from its definition;

four sets of cover tiles each of said sets of color tiles having a different and distinct characteristic color corresponding to the different and distinct characteristic colors of said four player pieces respectively, a player utilizing said cover tiles for covering the letter of the player space on which he has landed once he correctly guesses the word whose definition is read from the selected card to indicate that that player has captured that particular letter; and manually-operated chance means for indicating the number of player spaces a player may move his playing piece about the sides of the game during a particular turn, the space on which he lands indicating the color of the card to be selected and the letter on the player space indicating the word he must guess from the given definition contained on the selected card.

2. The game of claim 1 wherein "n" equals seven so that there are seven player spaces between each pair of opposite corner spaces for a total of 28 player spaces, each of said player spaces containing one different and distinct letter of the alphabet with the remaining two spaces containing a first and second special symbol, respectively.

3. The game of claim 2 wherein each of said individual cover tiles are dimensioned to be operatively received over the indicia means on the player space which a player lands on a given turn for operatively covering the letter contained thereon to indicate that the player whose color corresponds to that of the color tile so disposed has captured that particular letter of the alphabet.

4. The game of claim 1 wherein each of said four sides includes a set of seven player spaces, two of said sides including seven different and distinct letters of the alphabet on each of the corresponding two sets of seven player spaces respectively, with the remaining two sides of the playing board including six different and distinct letters of the alphabet on each of the corresponding two sets of seven player spaces and one of first an second special symbols on its corresponding remaining player space so that a total of 28 player spaces between the four corners of the board represent the 26 letters of the alphabet plus first and second special symbols.

5. The game of claim 4 wherein said chance means includes a conventional die having six sides with dots on each side indicating the numbers 1–6, respectively.

6. The game of claim 1 further including means for positioning each of said four sets of cards on the interior of the game board, means for selectively storing the four sets of cover tiles on the interior portion of the game board, means for storing the four player pieces on the interior portion of the game board and means for storing the marker means on the interior portion of the game board.

7. The game of claim 6 wherein said storage means includes a generally square tray rotatable about its central axis and including four central compartments for operatively storing said four player pieces and said four sets of marker means, four corner areas for storing said four sets of cover tiles, and four generally rectangular card tray portions operatively disposed between adjacent corner portions of said tray for housing the four sets of cards therein.

8. The game of claim 7 further including a pair of defined spaces on the interior portion of the game board adjacent a given players correspondingly colored side for housing said earned marker pegs during play so that all players can at any time determine the number of marker pegs earned by a given player.

9. The game of claim 1 wherein "n" equals seven, wherein each of said four sets of marker means including three marker pegs; and wherein each of said four sets of cover tiles includes fourteen pieces.

10. The game of claim 9 wherein each of said marker means is generally cylindrical and each of said cover tiles is generally rectangular and dimensioned to completely cover any given letter on said player spaces.

11. A word definition and spelling game combination comprising:

a generally square game board including four generally square corner spaces and seven player spaces operatively disposed between each pair of adjacent corner spaces defining four sets of seven player spaces for a total of 28 player spaces evenly divided about the board;

four player pieces representing up to four players in the game, each of said four player pieces having a different and distinct characteristic color so that each represents a unique player;

chance means for determining how many player spaces a player moves his player piece around the board on each given turn;

each of the four sets of seven player spaces disposed between opposite corners of the game board, each of the four sets of seven player spaces having a different and distinct characteristic color corresponding to the colors of said four player pieces, and each of said individual player spaces includes indicia means thereon for defining a first set of letters of the alphabet along one side of the board, a second set of letters along the second side of the board, a third set of letters of the alphabet along the third side of the board, and a fourth set of letters of the alphabet along the fourth side of the board, said sets of letters including different and distinct letters and representing all twenty-six letters of the alphabet;

said different and distinct letters of the alphabet occupying 26 of the 28 player spaces with the remaining two player spaces including indicia means for defining first and second special symbol means respectively;

a deck of custom playing cards divided into four different and distinct sets of cards, each of said four sets having a different and distinct characteristic color corresponding to the colors of the four different and distinct sides of the game board, each of the different and distinct colored sets of cards corresponding to different and distinct letter categories, each card having a set of definitions on one side of the card equal to the number of letters of the alphabet disposed on the particular side of the board represented by that particular color and a corresponding number of properly spelled words which correspond to those definitions disposed on the opposite side of said card; a player landing on a particular space on a particular side of the board corresponding to one of the different and distinct characteristic colors having a correspondingly colored card selected from the deck, and the definition of the word starting with the letter on the player space on which the player is located on that turn being read to him and he being read to guess the word corresponding to that definition and to properly spell the word thereafter;

four sets of 14 cover pieces, each of said four sets having a different and distinct characteristic color corresponding to the different and distinct characteristic colors of the four different and distinct player pieces, one of said cover pieces being earned each time a player correctly guesses the word whose definition is given to him from a selected card and a cover piece corresponding to his particular color being then placed over the letter on the player space on which he is located to signify that he has captured that letter;

four sets of marker means, each set of marker means having a different and distinct characteristic color corresponding to the different and distinct colors of the four player pieces, one of said marker means being earned each time the player first guesses the word corresponding to the definition given and then correctly spells that word to earn one of said marker pieces which may be exchanged in sets to earn additional cover pieces for covering any particular letter on the board which has not been previously covered; and said cover tiles being dimensioned to cover the indicia means corresponding to the letters of the alphabet located on the corresponding player spaces to signify that a player whose correspondingly colored tile is over the letter has captured a given letter, and the player who captures the most letters being declared the winner of the game.

12. The game of claim 11 wherein said first special symbol means located on at least one side of the board within one of the set of seven player spaces disposed thereon signifies that when a player lands on the player space bearing said first special symbol means, he may choose any letter that his opponent has already covered and force his opponent to uncover the chosen letter by correctly guessing the word whose definition corresponds to the definition on the card corresponding to that color of the player space and to the particular letter under the opponent's tile, and wherein a player space on another side of the board includes said second special symbol means which enables the player landing thereon to choose any letter that his opponent has already covered and uncover it by correctly guessing the word indicated by the properly selected card and spelling same before continuing his turn.

13. The game of claim 11 further including apparatus means for holding four stacks of different and distinct colored sets of cards; for temporarily storing four player pieces; for temporarily storing said marker means; for temporarily storing said cover tiles; and for storing said die when not in use.

14. The game of claim 13 wherein said apparatus means includes a generally square tray means, said tray means being rotatable about its axis to enable any particular player to rotate the tray to choose a card of a given color when it is nearest him, said tray means including four generally rectangular card trays for holding said four sets of different and distinct colored cards; four compartments for storing the corresponding four different and distinct colored sets of marker means and the four player pieces; and storage areas for stacking and storing said four sets of cover tiles.

15. A word/definition/spelling board game apparatus comprising:

a generally rectangular game board having four corner spaces and four sets of seven playing spaces each disposed sequentially between opposite corner spaces, each of said four sets of player spaces having a different and distinct characteristic color and each of said player spaces bearing indicia means, wherein 26 of said player spaces bear a different and distinct alphabetical letter of one of the 26 letters of the alphabet and the remaining two of said player spaces bearing a first and second special symbol means respectively;

four player pieces each having a different and distinct characteristic color corresponding to the different and distinct characteristic colors of the four sets of the player spaces, respectively;

four sets of marker means, each set of marker means including a different and distinct characteristic color corresponding to the colors of said player pieces;

four sets of cover tiles, each of said sets of cover tiles having a different and distinct characteristic color corresponding to the colors of said player pieces; and a deck of playing cards including four sub-decks each having a different and distinct characteristic color corresponding to the colors of said four player pieces, each of the cards within a given colored set including a plurality of definitions on one side thereof and the plurality of properly spelled words corresponding to said definitions on the other side of said card, the predetermined number of definitions and words on each card being dependent upon the particular number of letters of the alphabet on a particular side of the board corresponding to said different and distinct characteristic color; and chance means for determining the number of spaces a player piece moves on a given turn, the player space on which the player piece lands on a given turn having its different and distinct characteristic color of that given set of player spaces used to decide the color of card selected for that player, and the definition selected depending upon the first letter of the word to be defined on said card corresponding to the particular letter indicated on the player space on which the player piece is located on that turn.

16. The game apparatus of claim 15 wherein two sets of the four sets of player spaces include one different and distinct letter of the alphabet in each of the seven blocks whereas the other of the two sets of seven playing spaces on the other two sides of the game board include only six different and distinct letters of the alphabet in the seven playing spaces with the two remaining playing spaces of said other two sides including said first and second special symbol means for enabling a player to uncover a letter previously covered by an opponent if he has the proper answers to the selected definition on the card corresponding to the color and letter of the player space whose letter is covered by the opponent's indicator means.

17. The game of claim 15 further including holding means for positioning said sets of cards, said sets of cover tiles, and said sets of marker means on the interior of said game board during play.

18. The game of claim 17 wherein said holding means includes a tray for operatively carrying at least said four sub-decks of cards, said marker means, and said cover tiles.

19. The game of claim 18 wherein said tray is generally rectangular and includes four central compartments for storing said four player pieces and said four sets of marker means; four corner spaces for temporarily storing said four sets of cover tiles; and four generally rectangular card holding trays operatively disposed between opposite pairs of said corner spaces for operatively receiving and temporarily storing the four sub-decks of different color cards.

20. The game of claim 15 wherein each of said four sub-decks of cards includes at least one hundred different and distinct cards; wherein each of said four sets of marker means includes at least two markers; and wherein each of said four sets of cover tiles includes at least fourteen tiles, each of said tiles being generally rectangular and sized to substantially cover any given letter on the board.

* * * * *